United States Patent [19]

Shioda

[11] 4,411,303

[45] Oct. 25, 1983

[54] SAND MOLD-PRODUCING APPARATUS

[75] Inventor: Toshiyuki Shioda, Oobu, Japan

[73] Assignee: Kabushiki Kaisha Toyoda Jidoshokki Seisakusho, Aichi, Japan

[21] Appl. No.: 191,422

[22] Filed: Sep. 29, 1980

[30] Foreign Application Priority Data

Oct. 1, 1979 [JP] Japan ..... 54-126964
Oct. 1, 1979 [JP] Japan ..... 54-126965
Jul. 10, 1980 [JP] Japan ..... 55-98372[U]

[51] Int. Cl.[3] ..... B22C 15/28; B22C 17/00

[52] U.S. Cl. ..... 164/182; 164/195; 164/200

[58] Field of Search ..... 164/195, 200, 38, 182, 164/207, 212

[56] References Cited

U.S. PATENT DOCUMENTS

Re. 28,735 3/1976 Lund et al. ..... 164/195
100,320 3/1870 Peet ..... 164/207
3,528,481 9/1970 Lund ..... 164/200 X
3,589,431 6/1971 Fellows ..... 164/182 X

FOREIGN PATENT DOCUMENTS 48-12609 4/1973 Japan ..... 164/200
54-110126 8/1979 Japan ..... 164/207
54-110927 8/1979 Japan ..... 164/207
1456580 11/1976 United Kingdom ..... 164/195

*Primary Examiner*—Gus T. Hampilos
*Assistant Examiner*—J. Reed Batten, Jr.
*Attorney, Agent, or Firm*—Burgess, Ryan and Wayne

[57] ABSTRACT

A match plate mold-producing apparatus is provided with a flask assembly which has a pair of molding flasks movable toward and away from one another along a fixed guide means, and a flask mover mechanically interconnecting between the pair of molding flasks and actuating movement of the molding flasks, the flask mover per se being arranged so as to be movable with the pair of molding flasks.

7 Claims, 12 Drawing Figures

SAND MOLD-PRODUCING APPARATUS

FIELD OF THE INVENTION

The present invention relates to the production of containerless or flaskless sand molds and, more particularly, relates to an improvement in an apparatus for producing flaskless sand molds by the employment of a match plate carrying thereon a pattern or patterns and molding flasks.

BACKGROUND OF THE INVENTION

Diverse match plate molding machines are conventionally used for producing flaskless sand molds. One typical example of the match plate molding machine is disclosed in Japanese Laid-Open Patent Application No. 54(1979)-110126. This match plate molding machine is provided with a match plate carrying thereon patterns, at least a pair of molding flasks for an upper and a lower sand mold, a pair of squeezing devices for compacting molding sand, and diverse means for removing upper and lower flaskless sand molds from the molding flasks. The pair of molding flasks is alternately positioned in a first mold-forming station in which a match plate is vertically held between the pair of squeezing devices movable toward and away from one another along a horizontal axis, and in a second mold-removing station in which a mold-jointing operation and a mold-removing operation are carried out by the cooperation of the diverse removing means. When the pair of molding flasks are positioned in the first mold-forming station, a mold-forming operation including filling of molding sands into the molding flasks, squeezing or compacting of the filled molding sands, and parting of the squeezed molding sands from the patterns of the match plate, is carried out by cooperation of the match plate, the molding flasks and the squeezing devices. However, during the mold-forming operation, difficulties such as breaking of the match plate and collapsing of sand molds sometimes occur. Therefore, in order to obviate the problems encountered with the conventional match plate molding machine, it is desired to provide an appropriate means for improving the mold-forming operation of the conventional match plate molding machine, for the purpose of eventually producing flaskless sand molds of a high quality.

SUMMARY OF THE INVENTION

An object of the present invention is to provide an improvement in the sand mold-producing performance of a conventional match plate molding apparatus of the type disclosed in Japanese Laid-Open Patent Application No. 54(1979)-110126.

Another object of the present invention is to provide a sand mold-producing apparatus having an appropriate means for preventing collapsing of sand molds during the parting of the sand molds from the patterns carried on the match plate.

The present invention will become apparent from the ensuing description of preferred embodiments of the present invention with reference to the accompanying drawings wherein.

Figure 1:
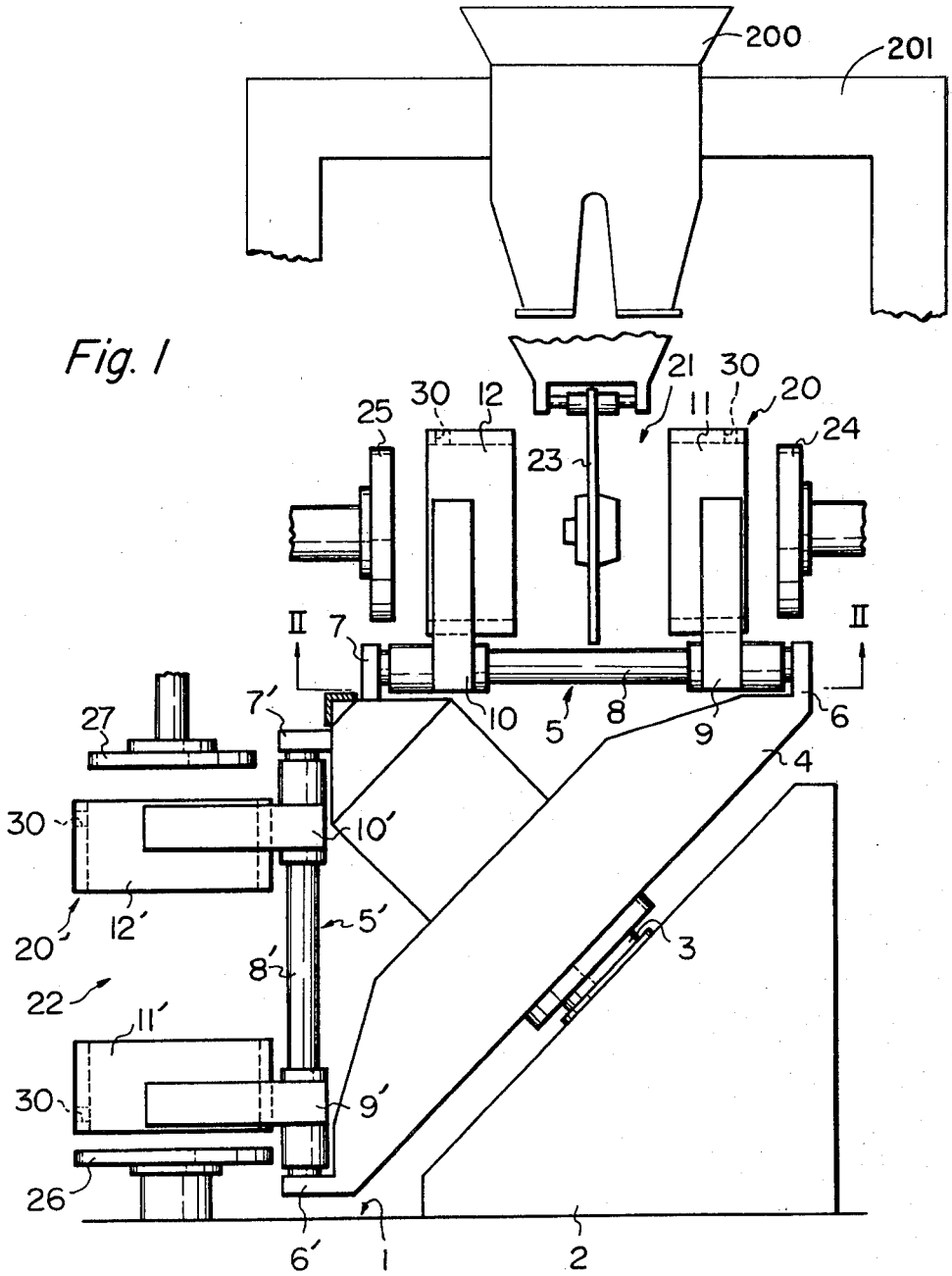
FIG. 1 is a front elevational view of a match plate molding apparatus according to an embodiment of the present invention.

It should be noted that in FIGS. 1 through 12, illustrating three embodiments of the present invention, the same reference numerals designate the same or like elements.

Figure 2:
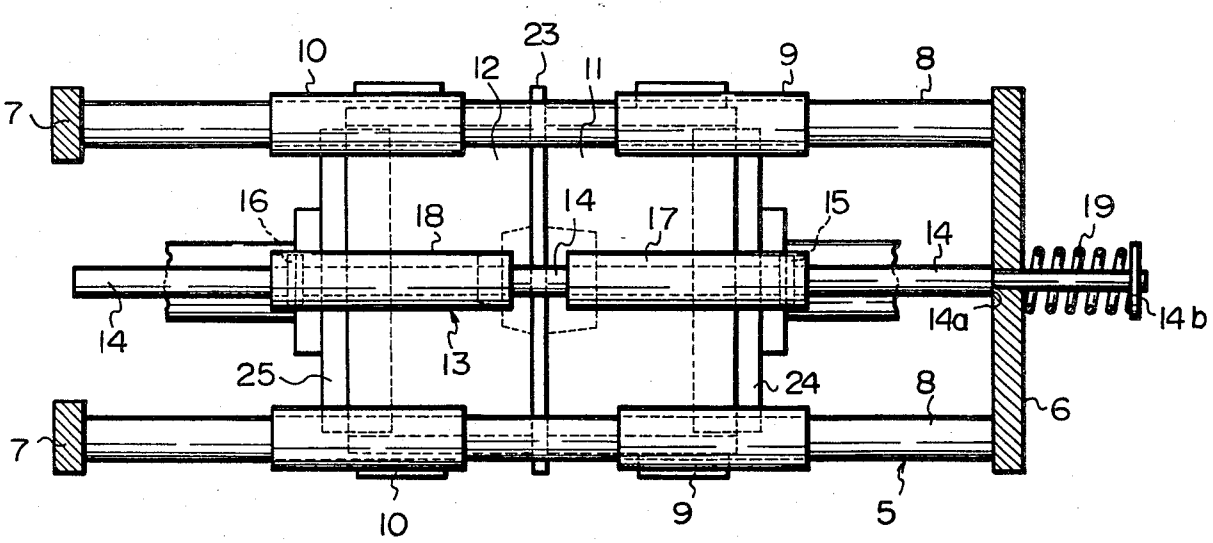
FIG. 2 is a cross-sectional view taken along the line of II—II of FIG. 1.

Referring now to FIGS. 1 and 2, a match plate molding apparatus, according to an embodiment of the present invention, is provided with a base 2 placed on a ground floor 1. On the base 2, a shaft 3 is mounted so as to incline forty-five degrees from a horizontal line. A flask device 4 is rotatably mounted on the shaft 3. The flask device 4 is provided with a pair of guide means 5 and 5' which are arranged so as to incline forty-five degrees from the axis of the shaft 3 and so as to be symmetrical with one another. The guide means 5 is comprised of two guide rods 8 attached to brackets 6 and 7 of the flask device 4, while the guide means 5' is comprised of two guide rods 8' attached to brackets 6' and 7' of the flask device 4. On the guide rods 8, is axially slidably mounted, a pair of flask bases 9 and 10 to which a molding flask 11 for a lower mold, and a molding flask 12 for an upper mold, are attached respectively. Further, on the guide rods 8', is axially slidably mounted, a pair of flask bases 9' and 10' to which a molding flask 11' for a lower mold and a molding flask 12' for an upper mold are attached respectively. Movement of the molding flasks 11 and 12 toward and away from one another is actuated by a flask mover 13 which mechanically interconnects between the flasks 11 and 12. Movement of the molding flasks 11' and 12' toward and away from one another is also actuated by a similar flask mover (not shown in FIGS. 1 and 2) which mechanically interconnects between the flasks 11' and 12'. The flask movers may be attached to the respective molding flasks 11, 12 and 11', 12' either directly or by means of the respective flask bases 9, 10 and 9', 10'. As illustrated in FIG. 2, the flask mover 13 for the molding flasks 11 and 12 is comprised of a common piston rod 14, a pair of pistons 15, 16 provided for the common piston rod 14, and a pair of cylinders 17 and 18 which have therein the pistons 15 and 16, respectively, and are attached to the molding flasks 11 and 12, respectively. It should here be understood that the flask mover for the molding flasks 11' and 12' has the same structure and arrangement as those of the above-mentioned flask mover 13. Therefore, typically, the structure and the arrangement of the flask mover 13 will be further described below. That is, as is best illustrated in FIG. 2, one end of the piston rod 14 extends toward and through the bracket 6 and is urged against the bracket 6 by means of a compression spring 19 which is disposed between an outer end of the bracket 6 and a flange member **14*b* attached to the outermost end of the piston rod 14. The movement of the piston rod 14 toward the bracket 6 is restricted by a step 14*a* provided for the piston rod 14. On the other hand, a given amount of play of the piston rod 14 away from the bracket 6 is permitted against the force of the compression spring 19. At this stage, the assembly of the guide means 5, the pair of molding flasks 11 and 12, and the flask mover 13 will be hereinafter referred to as flask assembly 20, and the other assembly of the guide means 5', the pair of molding flasks 11' and 12', and the flask mover for the molding flasks 11' and 12' will be referred to as flask assembly 20'. The flask assemblies 20 and 20' are alternately brought into a mold-forming station 21 and a mold-removing station 22 by the rotation of the flask device 4. FIG. 1 illustrates the case where the flask assembly 20 is positioned in the mold-forming station 21 in which the guide means 5 of the flask assembly 20 is horizontal, and the flask assembly 20' is positioned in the mold-removing station 22 in which the guide means 5' of the flask assembly 20' is vertical to the ground floor 1. In the mold-forming station 21, a match plate 23 is arranged so as to be horizontally movable and is vertically held between the molding flasks 11 and 12 or the molding flasks 11' and 12'. A squeeze plate 24 and a squeeze plate 25 are arranged in the mold-forming station so that the squeeze plate 24 is horizontally moved into and away from the molding flask 11 or 11', and so that the squeeze plate 25 is horizontally moved into and away from the molding flask 12 or 12'. The horizontal movement of the squeeze plates 24 and 25 is actuated by fluid cylinder devices which will be described later. In a lower position of the mold-removing station 22, a mold support device 26 is arranged so as to be vertically lifted or lowered for the purpose of supporting thereon produced flaskless sand molds. A mold-pressing device 27 is arranged in an upper position of the mold-removing station 22 so as to be vertically lowered for the purpose of pressing down produced sand molds until the produced sand molds are removed from the molding flasks 11 and 12 or 11' and 12'. In FIG. 1, reference numeral 30 designates a sand supply port provided for each of the molding flasks 11, 12, 11' and 12'. A sand supply device is arranged in an upper position of the mold-forming station 21**.

Figure 12:
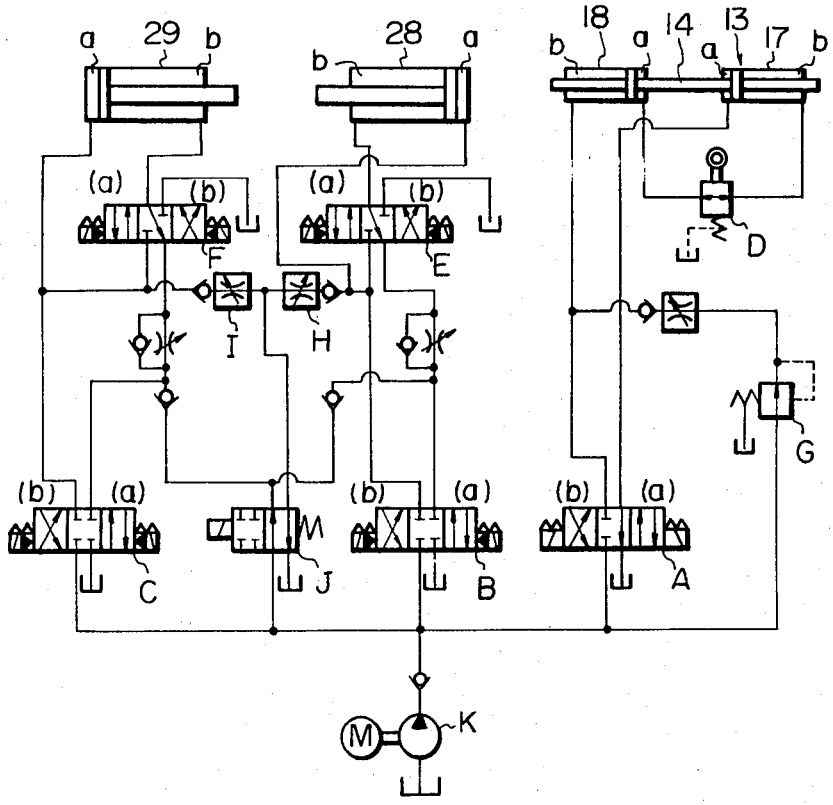
FIG. 12 is a circuit diagram of a pressurized fluid system commonly employed for operating the match plate molding apparatuses according to the three embodiments of the present invention.

Referring now to FIG. 12 in addition to FIGS. 1 and 2, there is illustrated a circuit diagram of a pressurized fluid system which is employed for operating the cylinders 17 and 18 of the flask mover 13 and cylinders 28 and 29 of the squeeze plates 24 and 25. It should be noted that in the circuit diagram of FIG. 12, cylinders of the flask mover for the molding flasks 11' and 12' are omitted for convenience sake. In the circuit of FIG. 12, "A" designates a direction control valve for the fluid cylinders 17 and 18, and "B" and "C" designate direction control valves for the fluid cylinders 28 and 29, respectively. "D" is a speed control valve for adjusting the operating speed of the fluid cylinders 17 and 18, and the actuation of the speed control valve "D" is accomplished, for example, by the utilization of movement of the molding flasks 11 and 12. "E" and "F" designate speed control valves for adjusting the operating speed of the fluid cylinders 28 and 29. "G" is a pressure control valve for controlling the pressure of the fluid supplied toward the fluid cylinders 17 and 18 during the mold-parting operation. "H" and "I" are throttling valves for regulating the operating speed of the fluid cylinders 28 and 29 during the mold-parting operation. "J" is a shift valve which controls the shifting of the mold-parting operation. "K" is a fluid pump provided with a drive motor M. It should be noted that FIG. 12 illustrates an initial condition in which not only the molding flasks 11 and 12 are moved away from one another but also the squeeze plates 24 and 25 are moved away from one another.

The operation for producing upper and lower flaskless sand molds by the employment of the pair of molding flasks 11 and 12 of the flask assembly 20 will now be described with reference to FIGS. 1, 2 and 12.

When the flask assembly 20 is positioned in the mold-forming station 21 as illustrated in FIG. 1, the direction control valve "A" is initially shifted to the position "b", and this position "b" of the direction control valve "A" is continuously maintained until the squeezing operation of the molding sand, which will be described later, is completed. As a result, a pressurized fluid is supplied from the pump K to a fluid chamber "a" of the fluid cylinder 17. Accordingly, the fluid cylinder 17 starts to move toward the fluid cylinder 18. As soon as the fluid cylinder 17 moves, a pressurized fluid within a fluid chamber "b" of the fluid cylinder 17 is sent to a fluid chamber "a" of the fluid cylinder 18. As a result, the fluid cylinder 18 moves toward the fluid cylinder 17. Accordingly, the molding flasks 11 and 12 move toward one another and finally, sandwich therebetween the match plate 23. It should here be noted that since the amount of movement of the fluid cylinder 17 is equal to that of the fluid cylinder 18, no horizontal movement of the match plate 23 occurs when the match plate 23 is sandwiched by the molding flasks 11 and 12. At this stage, immediately before the molding flasks 11 and 12 abut against the match plate 23, the speed control valve "D" is actuated by an appropriate cam attached to any one of the molding flasks 11 and 12, so that the moving speed of the fluid cylinders 17 and 18 and therefore, the moving speed of the molding flasks 11 and 12 is lowered. As a result, both molding flasks 11 and 12 are able to smoothly abut against the match plate 23 without giving any shock to the match plate 23. On the other hand, the speed control valves "E" and "F" are both simultaneously shifted to their respective position "a", and the direction control valves "B" and "C" are both simultaneously shifted to their respective positions "a". Further, the shift valve "J" is shifted to its actuated position from the initial normal position. As a result, fluid chambers "a" of the fluid cylinders 28 and 29 are respectively supplied with a pressurized fluid not only from the pump "K" but also from chambers "b" of the fluid cylinders 28 and 29. Accordingly, piston rods of the fluid cylinders 28 and 29, and therefore the squeeze plates 24 and 25 are quickly advanced toward the match plate 23. Before the squeeze plates 24 and 25 enter into the molding flasks 11 and 12, respectively, the speed control valves "E" and "F" are restored to their initial neutral positions, so that the advancing speed of the squeeze plates 24 and 25 is lowered. When the squeeze plates 24 and 25 enter into the molding flasks 11 and 12, and come to predetermined positions within the flasks 11 and 12, respectively, the direction control valves "B" and "C" are restored to respective initial neutral positions. As a result, the advancement of the squeeze plates 24 and 25 is stopped. Consequently, molding cavities are defined within the molding flasks 11 and 12 positioned adjacent to both sides of the match plate 23. At this stage, molding sand is supplied from a conventional sand blower through blow head hopper 200 supported on supports 201 into the molding cavities through the sand supply ports 30 of the molding flasks 11 and 12 until the molding cavities are completely filled with the molding sand. It should be noted that since the molding flasks 11 and 12 are urged toward the match plate 23 by the fluid cylinders 17 and 18, no leakage of the molding sand from the molding cavities through the connections between the match plate 23 and both molding flasks 11 and 12 occurs. Upon completion of the filling of the molding sand into the molding cavities, the direction control valve "B" is again shifted to the position "a", nevertheless the direction control valve "C" is left in the neutral position. As a result, the squeeze plate 25 is kept stationary in the molding flask 12, and the squeeze plate 24 is advanced into the molding flask 11 by the actuation of the fluid cylinder 28. Therefore, the squeezing operation of the molding sand within the molding cavities is processed in the following manner. That is, the advancement of the squeeze plate 24 squeezes the molding sand within the molding flask 11 while urging the match plate 23 to horizontally move toward the stationary squeeze plate 25. At this stage, since the molding flasks 11 and 12 are capable of being moved together toward the squeeze plate 25 against the force of the compression spring 19, the advancement of the squeeze plate 24 eventually moves the match plate 23 and the molding flasks 11 and 12 toward the stationary squeeze plate 25. Accordingly, the molding sand within the molding flask 12 is eventually squeezed. Thus, the squeezing of the molding sand within both of the molding flasks 11 and 12 is accomplished. It should here be noted that since the molding flasks 11 and 12 are mechanically interconnected with one another by the flask mover 13 and since the flask mover 13 per se is capable of being moved together with the molding flasks 11 and 12 and the match plate 23, the match plate 23 is not subjected to any force causing breakage or shearing of the match plate 23. When the direction control valve "B" is restored to the neutral position, the advancement of the squeeze plate 24 is stopped, so that the squeezing of the molding sand is completed. Upon completion of the above-mentioned squeezing operation, the direction control valve "A" is restored to the initial neutral position and concurrently, the shift valve "J" is shifted to its initial normal position. As a result, a chamber "b" of the fluid cylinder 18 is supplied, via the pressure regulating valve "G", with pressurized fluid the pressure of which is lowered by the valve "G", so that the molding flasks 11 and 12 are permitted to move away from one another. On the other hand, chambers "b" of the fluid cylinders 28 and 29 are supplied with a pressurized fluid, so that retraction of the piston rods of the cylinders 28 and 29, and therefore retraction of the squeeze plates 24 and 25 are performed at a low speed. At this stage, it should be understood that the actuation of the fluid cylinders 28 and 29 and the actuation of the fluid cylinders 17 and 18 are controlled so that the retraction of the squeeze plates 24 and 25 is synchronized with the retraction of the molding flasks 11 and 12. By the retractions of the squeeze plates 24 and 25 and the molding flasks 11 and 12, parting of the sand molds from the match plates 23 is accomplished. Thereafter, the direction control valve "A" is shifted to the position "a", the direction control valves "B" and "C" are respectively shifted to the position "b", and the speed control valves "E" and "F" are respectively shifted to the position "b". As a result, the molding flasks 11 and 12 are completely separated from one another, and the squeeze plates 24 and 25 are completely retracted. Thereafter, the flask device 4 is rotated through one hundred and eighty degrees, so that the flask assembly 20 is brought into the mold-removing station 22 and so that the flask assembly 20' is brought into the mold-forming station 21. In the mold-removing station, inspection of the sand molds within the molding flasks 11 and 12 and insertion of a core into the sand mold within the molding flask 11 are performed. Subsequently, by the actuation of the flask mover 13, jointing of the sand molds within both molding flasks 11 and 12 is conducted. Thereafter, the mold-pressing device 27 is lowered until the sand molds are removed from the molding flasks 11 and 12. The removed sand molds are placed on the lifted mold-support device 26. Thus, production of the flaskless sand molds by the employment of the flask assembly 20 is completed. The flaskless sand molds on the mold-support device 26 are thereafter delivered to the subsequent casting station. On the other hand, while the mold-removing operation is carried out with the flask assembly 20 in the mold-removing station 22, the mold-forming operation, by the employment of the flask assembly 20', is conducted in the mold-forming station.

From the foregoing description of the embodiment of FIGS. 1 and 2, it will be understood that the following advantages can be obtained from the present invention.

(1) In the mold-forming station, since the flask mover is able to move together with the molding flasks and the match plate during the sand-squeezing operation, the match plate is not subjected to any shearing force causing breakage of the match plate.

(2) In the mold-forming station, since the molding sand within the molding flasks is subjected to an equally distributed squeezing pressure, the sand molds can be homogeneously hardened. Therefore, the sand molds can be of high quality.

(3) Since the flask mover can be utilized for accomplishing the jointing of the sand molds, the jointing operation of the sand molds per se is very accurate.

Figure 3:
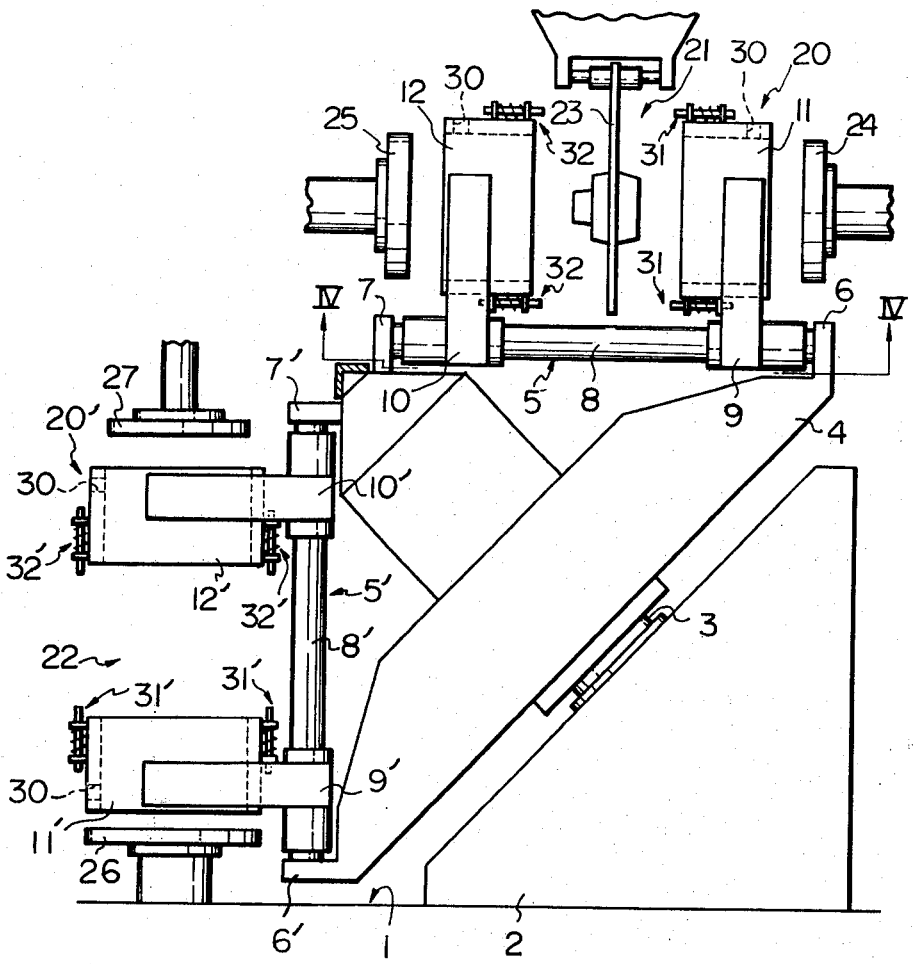
FIG. 3 is a front elevational view of a match plate molding apparatus according to another embodiment of the present invention.
Figure 4:
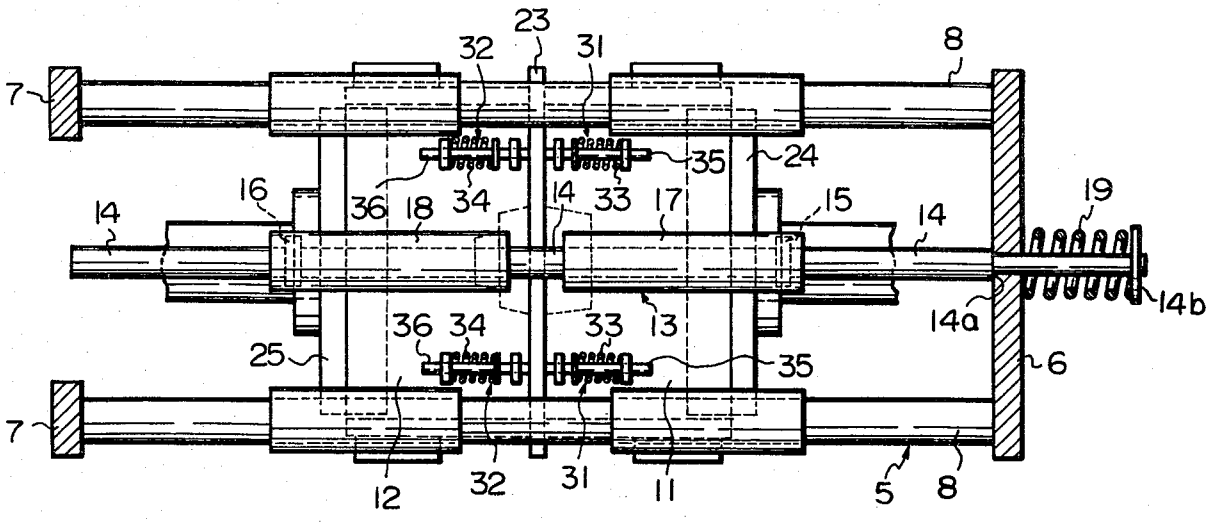
FIG. 4 is a cross-sectional view taken along the line IV—IV of FIG. 3.

FIGS. 3 and 4 illustrate a match plate molding apparatus according to another embodiment of the present invention. Throughout FIGS. 3 and 4, the same reference numerals as those in FIGS. 1 and 2 designate the same or like elements and parts. It should be understood that the general arrangement and operation of the apparatus illustrated in FIGS. 3 and 4 are similar to those of the apparatus illustrated in FIGS. 1 and 2. The characteristic difference of the apparatus of FIGS. 3 and 4 from the apparatus of FIGS. 1 and 2 resides in the fact that appropriate means for promoting a precise parting of sand molds from patterns of a match plate is provided for molding flasks for an upper and a lower sand mold.

The characteristic arrangement of the apparatus of FIGS. 3 and 4 will now be described.

Referring to FIGS. 3 and 4, molding flasks 11 and 12 of flask assembly 20 are provided with a plurality of elastic projection devices 31 and 32, respectively, and molding flasks 11' and 12' of flask assembly 20' are also provided with a plurality of elastic projection devices 31' and 32'. The elastic projection devices 31 and 31' are of the same structure and arrangement, and the elastic projection devices 32 and 32' are of the same structure and arrangement. These elastic projection devices 31, 31', 32, and 32' operate as means for promoting a precise parting of sand molds from patterns of a match plate, respectively, as described later. Now, the structure, arrangement and operation of the elastic projection devices 31 and 32 provided for the molding flasks 11 and 12 of the flask assembly 20 will be described in detail. As illustrated in FIG. 4, each of the elastic projection devices 31 is comprised of a projecting rod 35 capable of laterally inwardly projecting from an inner end face of the molding flask 11, and a spring 33 elastically urging the rod 35 to inwardly project from the end face of the molding flask 11. Each of the elastic projection devices 32 is comprised of a projecting rod 36 capable of laterally inwardly projecting from an inner end face of the molding flask 12, and a spring 34 elastically urging the rod 36 to inwardly project from the end face of the molding flask 12. At this stage, it should be understood that the elastic force of each of the elastic projection devices 31 is different from that of each of the elastic projection devices 32. In the embodiment of FIGS. 3 and 4, the elastic force of each of the elastic projection devices 32 provided for the molding flask 12 for an upper sand mold is adjusted so as to be stronger than that of each of the elastic projection devices 31 provided for the molding flask 11 for a lower sand mold. Moreover, it should be noted that the springs 34 of the elastic projection devices 32 are arranged so as to be in a slightly compressed condition for exhibiting a given amount of spring force even if the projecting rods 36 are projected to the maximum extent.

With the apparatus of FIGS. 3 and 4, which is provided with the above-mentioned characteristic arrangement, the mold-forming operation and the mold-removing operation are conducted in the same manner as the apparatus of FIGS. 1 and 2 by the employment of the pressurized fluid system illustrated in FIG. 12. Therefore, the characteristic operation of the elastic projection devices 31 and 32 will be described hereinbelow. It should naturally be understood that the operation of the elastic projection devices 31' and 32' is the same as that of the elastic projection devices 31 and 32.

When a flask device 20 is brought into a mold-forming station 21, the molding flasks 11 and 12 are initially moved toward one another by a flask mover 13 until a match plate 23 is sandwiched by the molding flasks 11 and 12. Thus, when the molding flasks 11 and 12 are abutted against both faces of the match plate 23, the projection rods 35 and 36 of the elastic projection devices 31 and 32 are also abutted against and pressed by the match plate 23. Therefore, the springs 33 and 34 of the devices 31 and 32 are compressed. As a result, the elastic projection devices 31 and 32 elastically urge the molding flasks 11 and 12 to move away from the match plate 23. At this stage, as previously described, the elastic urging force of the devices 32 is stronger than that of the devices 31. Subsequently, squeeze plates 24 and 25 are moved toward the match plate 23 until the squeeze plates 24 and 25 come into predetermined positions within the molding flasks 11 and 12. Thus, molding cavities are defined in the molding flasks 11 and 12. Thereafter, filling of the molding sand into the molding cavities and squeezing of the molding sand are in turn carried out. After completion of the squeezing of the molding sand, parting of the sand molds from the patterns carried on the match plate 23 is initiated by retraction of the squeeze plates 24 and 25 together with the molding flasks 11 and 12. At this stage, when the molding flasks 11 and 12 are moved away from the match plate 23, the elastic projection devices 32 of the molding flask 12 operate so as to press the match plate 23 against the inner end face of the molding flask 11, since the elastic urging force of the elastic projection devices 32 is stronger than that of the elastic projection devices 31. As a result, the parting of the sand mold of the molding flask 12 from the match plate 23 is promoted and gradually proceeding. When the sand mold of the molding flask 12 is separated from the match plate 23 and when the molding flask 12 is moved away from the match plate 23 until the projecting rods 36 of the elastic projection devices 32 are projected to the maximum extent the match plate 23 is now subjected to the pressing force exhibited by the elastic projection devices 31 of the molding flask 11. However, since no movement of the match plate 23 per se toward the molding flask 12 is permitted by the ends of the projecting rods 36 of the elastic projection devices 32, parting of the sand mold of the molding flask 11 from the match plate 23 is now gradually initiated. That is, it will be understood that the elastic projection devices 31 and 32 contribute to a gradual separation of the sand molds of the molding flasks 11 and 12 from the match plate 23. Therefore, according to the apparatus of FIGS. 3 and 4, precise parting of the sand molds from the patterns carried on the match plate 23 is guaranteed, and accordingly, collapsing or deformation of the sand molds does not occur. Upon completion of the mold-parting operation, the squeeze plates 24 and 25 and the molding flasks 11 and 12 are further retracted from the match plate 23. Thereafter, the flask assembly 20 is brought into the mold-removing station 22 where the mold-removing operation is conducted in the same manner as the apparatus of FIGS. 1 and 2.

FIGS. 5 through 11 illustrate a match plate molding apparatus according to a further embodiment of the present invention. Throughout FIGS. 5 through 11, the same reference numerals as those in FIGS. 3 and 4 designate the same or like elements and parts. It should be understood that the general arrangement and operation of the apparatus illustrated in FIGS. 5 through 11 are similar to those of the apparatus illustrated in FIGS. 3 and 4. The characteristic difference of the apparatus of FIGS. 5 through 11 from the apparatus of FIGS. 3 and 4 resides in the fact that the performance of elastic projection devices provided for the apparatus of FIGS. 5 through 11 is improved over that of the elastic projection devices 31, 31', 32, and 32'; of the apparatus of FIGS. 3 and 4. Therefore, the description of the elastic projection devices provided for the match plate molding apparatus of FIGS. 5 through 11 will be provided below.

Figure 5:
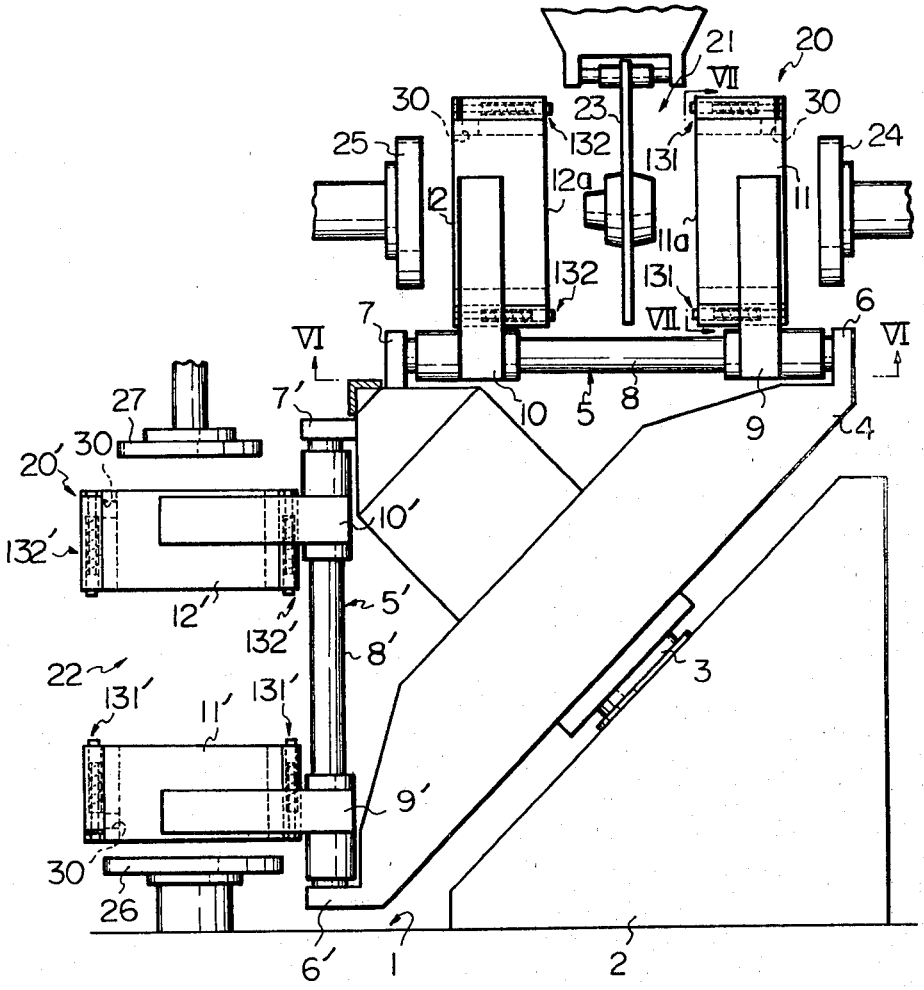
FIG. 5 is a front elevational view of a match plate molding apparatus according to a further embodiment of the present invention.
Figure 6:
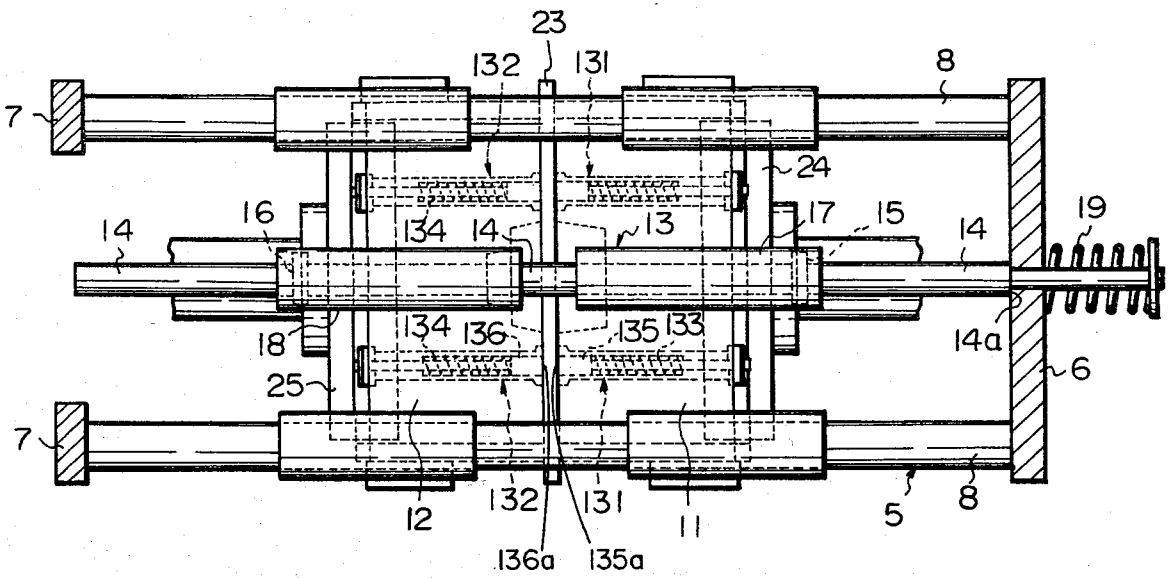
FIG. 6 is a cross-sectional view taken along the line VI—VI of FIG. 5.
Figure 7:
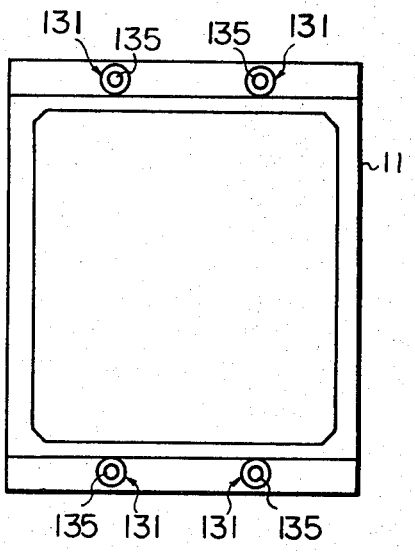
FIG. 7 is a partial view taken along the line VII—VII of FIG. 5 and illustrating a front face of a lower molding flask.

As illustrated in FIG. 5, a plurality of elastic projection devices 131 and a plurality of elastic projection devices 131' are arranged in appropriate positions of outer circumferences of molding flasks 11 and 11' for lower sand molds, respectively. It should be understood that the elastic projection devices 131 and 131' are of the same structure and operation. A plurality of elastic projection devices 132 and a plurality of elastic projection devices 132' are arranged in appropriate positions on outer circumferences of molding flasks 12 and 12' for upper sand molds. The elastic projection devices 132 and 132' are of the same structure and operation. The elastic projection devices 131 of the molding flask 11 cooperate with the elastic projection devices 132 of the molding flask 12 for the purpose of promoting parting of upper and lower sand molds of the molding flasks 11 and 12 from a match plate 23 when the mold-parting operation of a flask assembly 20 is carried out in a mold-forming station 21. On the other hand, elastic projection devices 131' of the molding flask 11' cooperate with the elastic projection devices 132' of the molding flask 12' for the purpose of promoting parting of upper and lower sand molds of the molding flasks 11' and 12' from a match plate 23 when the mold-parting operation of a flask assembly 20' is carried out in the mold-forming station 21. For convenience sake, the description of the elastic projection devices 131 and 132 provided for the molding flasks 11 and 12 of the flask assembly 20 will be provided below.

Figure 8:
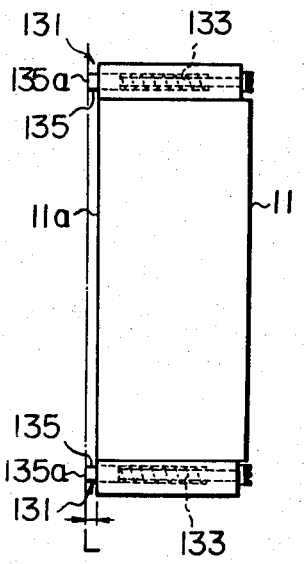
FIG. 8 is a side elevational view of the lower molding flask shown in FIG. 7.
Figure 9:
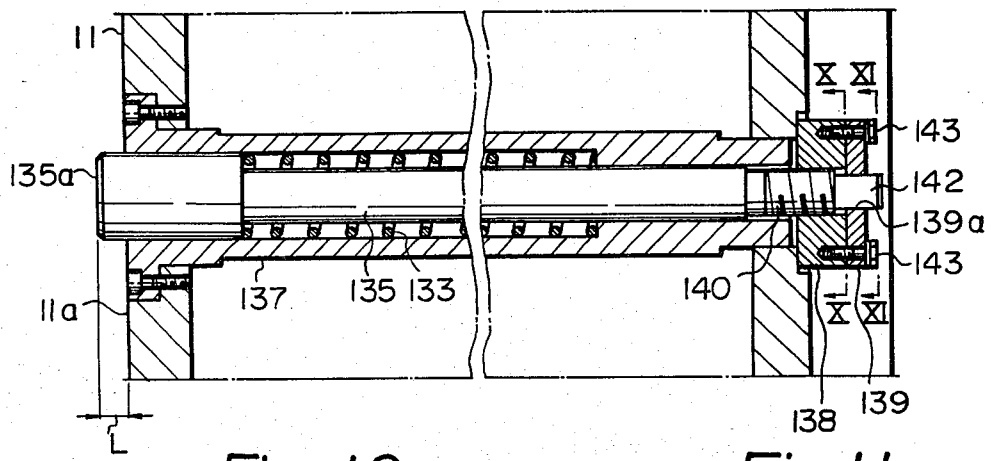
FIG. 9 is a cross-sectional view of a mold-parting forcing means employed in the apparatus of FIG. 5.
Figure 11:
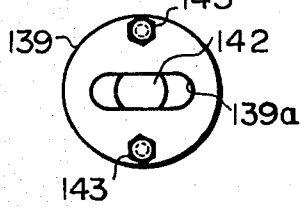
FIG. 11 is a view taken along the line XI—XI of FIG. 9 and illustrating a front view of a lock plate member.
Figure 10:
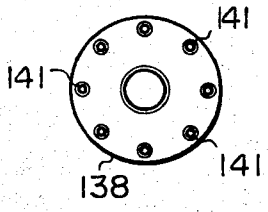
FIG. 10 is a view taken along the line X—X of FIG. 9 and illustrating a front view of a nut member.

As illustrated in FIGS. 6 through 11, each of the elastic projection devices 131 has a projecting rod 135 which is laterally movably housed in a casing 137 fixed to the molding flask 11. A front end 135*a* of each projecting rod 135 can be projected forwardly or retracted backwardly from an inner front end face 11*a* of the molding flask 11 and is always subjected to a spring force of a compression spring 133 which is housed within the casing 137. The compression spring 133 always presses the projecting rod 135 so as to be forwardly projected from the end face 11*a* of the molding flask 11. As best illustrated in FIGS. 8 and 9, when the projecting rod 135 is projected to the maximum extent by the action of the spring force of the compression spring 133, the front end 135*a* of the projecting rod 135 is forwardly distant "L" from the inner front end face 11*a* of the molding flask 11. The length "L" may be referred to as a maximum projection length of the projecting rod 135. However, as illustrated in FIG. 9, each elastic projection device 131 has means for adjusting the maximum projection length "L". The adjusting means is comprised of a nut member 138 threadedly engaged with a male screw portion 140 formed in a rear end portion of the projecting rod 135, and a lock plate 139 attached to the nut member 138 by means of screws 143. The nut member 138, threadedly engaged with the male screw portion 140 of the projecting rod 135, is arranged so as to abut against a bottom of a recess formed in the rear end face of the molding flask 11. That is, the nut member 138 is provided as an adjustable stop member for adjustably limiting the projection amount of the projecting rod 135 to the maximum projection length "L". The nut member 138 is formed with a plurality of threaded bores 141 as illustrated in FIG. 10. In the case of the nut member of FIG. 10, eight threaded bores 141 are formed. The lock plate 139 is formed with an extended bore 139*a* in which a flattened end 142 of the projecting rod 135 is fitted as illustrated in FIGS. 9 and 11. As previously stated, the lock plate 139 is attached to the nut member 138 by means of screws 143. In the case of this embodiment illustrated in FIGS. 9 and 11, two screws 143 are selectively engaged with two of the eight threaded bores 141 of the nut member 138. The lock plate 139 is provided for prevention of rotation of the nut member 138.

On the other hand, each elastic projection device 132 has a projecting rod 136 capable of projecting forwardly from an inner front end face 12*a* of the molding flask 12, and a compression spring 134 forwardly pressing the projecting rod 136. Although not illustrated in any of FIGS. 5 through 11, each elastic projection device 132 also has means for adjusting the maximum projection length of the projecting rod 136, which means has the same structure and arrangement as the adjusting means of the above-mentioned elastic projection devices 131. The difference between the elastic projection device 132 and the elastic projection device 131 resides in that the spring force exhibited by each spring 134 is stronger than that exhibited by each spring 133. Naturally, every compression spring 133 of the elastic projection devices 131 exhibits an equal spring force, and every compression spring 134 of the elastic projection devices 132 exhibits an equal spring force.

From the foregoing description of the elastic projection devices 131 and 132, it will be understood that the elastic projection devices 131, 131', 132, and 132' are improved over the elastic projection devices 31, 31', 32, and 32' of the apparatus of FIGS. 3 and 4 in that the former devices have a capability of adjusting the maximum projection lengths of respective projection rods 135 and 136. Therefore, when, for example, the elastic projection devices 131 and 131' are incorporated in the molding flasks 11 and 11' for lower sand molds, it is possible to adjust the maximum projection lengths of all projecting rods 135 so that the front ends 135*a* of all projecting rods lie on the same plane. As a result, when the elastic projection devices 131 and 131' are used as means for promoting parting of sand molds from the match plate 23, all forces applied from the elastic projection devices 131 and 131' to the match plate 23 can be equal. Consequently, during the mold-parting operation of the flask assembly 20 or 20', no deflection of the match plate 23 occurs. Accordingly, it is guaranteed that the parting of the sand molds from the match plate 23 can be accurately performed without causing any collapsing or deformation of the sand molds.

It should naturally be understood that the maximum projection lengths of all projecting rods 136 of the elastic projection devices 132 and 132' are also adjusted so that the front ends 136*a* of all projecting rods 136 lie on the respective same planes when the devices 132 and 132' are incorporated into the respective molding flasks 12 and 12'. It should further be understood that the mold-production operation of the flask assemblies 20 and 20' of the apparatus of FIGS. 5 through 11 is conducted in the same manner as the former two apparatuses of FIGS. 1 and 2 and FIGS. 3 and 4 by the employment of the pressurized fluid system of FIG. 12.

As will be understood from the above-mentioned description of the preferred three embodiments of the present invention, the match plate molding apparatus of the present invention can ensure that in the mold-forming station, squeezing of the molding sand and parting of the upper and lower sand molds from the patterns on the match plate are precisely conducted without causing any collapsing or deformation of the sand molds. Accordingly, the flaskless or containerless sand molds produced by the apparatus of the present invention can be of high quality.

I claim:

1. A sand mold-producing apparatus having a rigid base to establish therearound a mold-forming station and a mold-removing station, a sand blower means arranged in the mold-forming station for supplying molding sand under a pressure of air, a match plate carrying thereon a pattern or patterns and arranged to be movable in a predetermined direction perpendicular to the match plate, a flask device mounted on the base for holding a flask assembly for molding sand molds in the mold-forming station, and a sand-squeezing means having squeeze plates and actuator means for actuating a squeezing motion of the squeeze plates, wherein one squeeze plate remains stationary during the sand squeezing operation, the sand-squeezing means being arranged in the mold-forming station for cooperating with the match plate and the flask assembly, wherein said flask assembly comprises:

a guide means fixedly held on said flask device and extending in a direction perpendicular to said match plate;

a pair of molding flasks for an upper and lower sand mold, said molding flasks being mounted on said guide means and slidable along said guide means from a predetermined first position in which said molding flasks are spaced apart from one another, toward a predetermined second position in which said molding flasks sandwich therebetween said match plate; and a flask mover for mechanically interconnecting between said molding flasks while actuating a simultaneous slide motion of said pair of molding flasks, said flask mover being held by said flask device so as to be movable together with said match plate and said pair of molding flasks in said predetermined direction perpendicular to the match plate, wherein said flask mover comprises a single piston rod axially movably held on a bracket provided at one end of said flask device; a portion of the piston rod cooperating to urge piston rod passing through elastic means mounted on a side bracket, said elastic means and said portion of the piston rod cooperating to urge said piston rod toward the side of said bracket having said elastic means mounted thereon; a pair of spaced apart pistons arranged on said piston rod; and a pair of fluid-actuated cylinders slidably mounted on said piston rod, each of said pair of fluid-actuated cylinders housing therein one of said pistons and being connected to one of said molding flasks wherein the flask mover together with the match plate and the molding flasks are movable against the force of the elastic means in direct response to the squeezing movement of the sand-squeezing means, said pistons and cylinders being disposed on a side of said bracket remote from said elastic means.

2. A sand mold-producing apparatus according to claim 1, wherein said flask device comprises means for alternately positioning said flask assembly in said mold-forming station in which forming of said upper and lower sand molds is effected and in said mold-removing station in which removing of said upper and lower sand molds from said molding flasks is effected.

3. A sand mold-producing apparatus according to claim 1, wherein said flask assembly further comprises elastic means provided on each molding flask for urging each of said pair of molding flasks to individually part from said match plate when said molding flasks are positioned in said predetermined second position.

4. A sand mold-producing apparatus according to claim 3, wherein said elastic means on each molding flask comprise:

a first group of elastic projection devices attached to one of said pair of molding flasks, each of said elastic projection devices including a projecting rod capable of retractably projecting from one of said molding flasks toward said match plate when said flask assembly is positioned in said mold-forming station, and a compression spring for urging projection of said projecting rod; and a second group of elastic projection devices attached to the other of said pair of molding flasks, each of said second group of elastic projection devices including a projecting rod capable of retractably projecting from the other of said molding flasks toward said match plate when said flask assembly is positioned in said mold-forming station, and a compression spring for urging projection of said projecting rod.

5. A sand mold-producing apparatus according to claim 4, wherein said first group of elastic projection devices exhibit an elastic urging force the strength of which is different from that exhibited by said second group of elastic projection devices.

6. A sand mold-producing apparatus according to claim 4, wherein said projecting rod of each of said first and second groups of elastic projection devices comprises means for adjustably limiting the amount of projection of said projecting rod.

7. A sand mold-producing apparatus according to claim 6, wherein said limiting means of said projecting rod comprises a nut member threadedly engaged with a male screw portion formed on said projecting rod, said nut member coming into contact with a part of said molding flask when said projecting rod projects to a maximum extent, and a lock member attached to said nut member for preventing rotation of said nut member.

* * * * *